US005625909A

United States Patent [19]

Ericson

[11] Patent Number: 5,625,909

[45] Date of Patent: May 6, 1997

[54] SANITARY APPLIANCE WITH INDIRECT DISCHARGE

[76] Inventor: Kurt S. B. Ericson, Prins Boudewihnlaan 48, B-2970 Schilde, Belgium

[21] Appl. No.: 634,063

[22] Filed: Apr. 17, 1996

Related U.S. Application Data

[63] Continuation of Ser. No. 375,492, Jan. 19, 1995, abandoned.

[30] Foreign Application Priority Data

Sep. 2, 1994 [BE] Belgium ..... 09400148

[51] Int. Cl.[6] ..... E03C 1/24

[52] U.S. Cl. ..... 4/651; 4/619

[58] Field of Search ..... 4/286–288, 293, 4/650–653

[56] References Cited

U.S. PATENT DOCUMENTS

| | | | |
|---|---|---|---|
| 3,895,401 | 7/1975 | Walraven | 4/651 |
| 4,777,676 | 10/1988 | Ericson | 4/651 X |
| 5,272,775 | 12/1993 | Walraven | 4/651 X |

*Primary Examiner*—Charles E. Phillips

*Attorney, Agent, or Firm*—Larson & Larson, P.A.; James E. Larson

[57] ABSTRACT

Sanitary appliance (washbasin, bidet, bath, sink, etc . . . ) which comprises a main basin (2) in conjunction with an adjoining chamber (4), but where the basin (2) and the chamber (4) are separated from one another by an at least partially removable wall (3). The water in the basin (2) is in contact with chamber (4) via openings (14). The chamber (4) is provided with a discharge conduit which at the same time forms the overflow (15). Said discharge conduit is a virtually upright pipe (7, 8) which in the open state discharges the water and in the closed state retains the water in the basin. At least a portion of the removable wall (3) is joined to at least a portion of the upright pipe. FIG. 1*a*.

9 Claims, 7 Drawing Sheets

SANITARY APPLIANCE WITH INDIRECT DISCHARGE

CROSS REFERENCE TO RELATED APPLICATION

This is a continuation of Ser. No. 08/375,432 filed Jan. 19, 1995, now abandoned.

BACKGROUND OF THE INVENTION

The present invention relates to a sanitary appliance such as washbasin, bidet, bath, shower tub, sink, urinal or any other equivalent appliance, of the type which comprises a main basin and an adjoining chamber, the two separated by a wall, water or any other liquid in the basin being capable of being discharged via a water outfall in the adjoining chamber, and said water outfall comprising a virtually upright pipe which is displaceable between an open state, in which the water can be discharged, and a closed state in which the water remains in the basin.

An appliance of this type has been described by. applicant in the European Patent No. 202 308. According to this patent, at least one portion of the wall which separates the basin from the adjoining chamber is removable.

Appliances of this type look smart, and they can be shaped more simply, since no discharge opening and sealing plug is present in the underside, but they are still not widespread, since the chamber and the water discharge pipe are not readily accessible for cleaning nor for installing them. Even if a portion of the partition between the basin and the chamber is removable, as proposed in the said European patent, there remains a problem for cleaning the discharge pipe; moreover, the manufacture of the unit still presents problems.

SUMMARY OF THE INVENTION

It is an object of the present invention to present a sanitary appliance of the described type, with which the reported problems can be avoided.

According to the invention, the removable wall of the basin is attached to at least a portion of the virtually upright discharge pipe and the water discharge is controlled by the position of the discharge pipe. The joint between the removable wall and the discharge pipe can be permanent, so that both portions form one unit, but the join may also consist of an attachment, so that the two portions are attached to one another, but can nevertheless move with respect to one another and can be separated from one another. According to a first embodiment of the invention, the removable wall is rigidly attached to the discharge pipe or a section of the discharge pipe and is displaceable between a first position, in which the discharge of the water is prevented by the position of the discharge pipe attached to the wall with respect to the further water discharge, and a second position in which the water can flow away.

According to a further embodiment, the removable wall is attached to the discharge pipe (or a portion thereof), but the discharge pipe (or the portion thereof) can be displaced independently of the wall. The position of the virtually upright pipe is determined by a handle or a gripping section, displaceable independently of the removable wall.

Since the wall is removable and attached to at least a portion of the discharge pipe which is therefore also removable, cleaning of the chamber is simplified, and it is also much simpler to produce and install the appliance.

It will be evident that the discharge of the water in the open position of the upright pipe can be effected in any way known to those skilled in the art, the presence of one or more openings in the discharge pipe possibly constituting a simple solution. In the closed state, the upper rim of the discharge pipe forms the overflow of the basin.

According to the invention, the removable wall can have all kinds of shapes, which offers unlimited scope in designing the appliance; thus said wall may also form a unit with, for example, a portion of the bottom of the basin and/or of the top of the basin. The removable wall may also consist of a plurality of pieces, only one piece being attached to the discharge pipe.

The discharge pipe attached to the removable wall can be a piece of said pipe, with the possibility of the removable piece being placed in an extended fixed piece, but it may also be the entire pipe which is removable and fits into the further drain, if the design of the appliance permits this.

BRIEF DESCRIPTION OF THE DRAWINGS

The invention will be described below in more detail with reference to a few non-limiting specific embodiments with reference to the accompanying drawings, in which.

DETAILED DESCRIPTION OF THE DRAWINGS

Figure 1A:
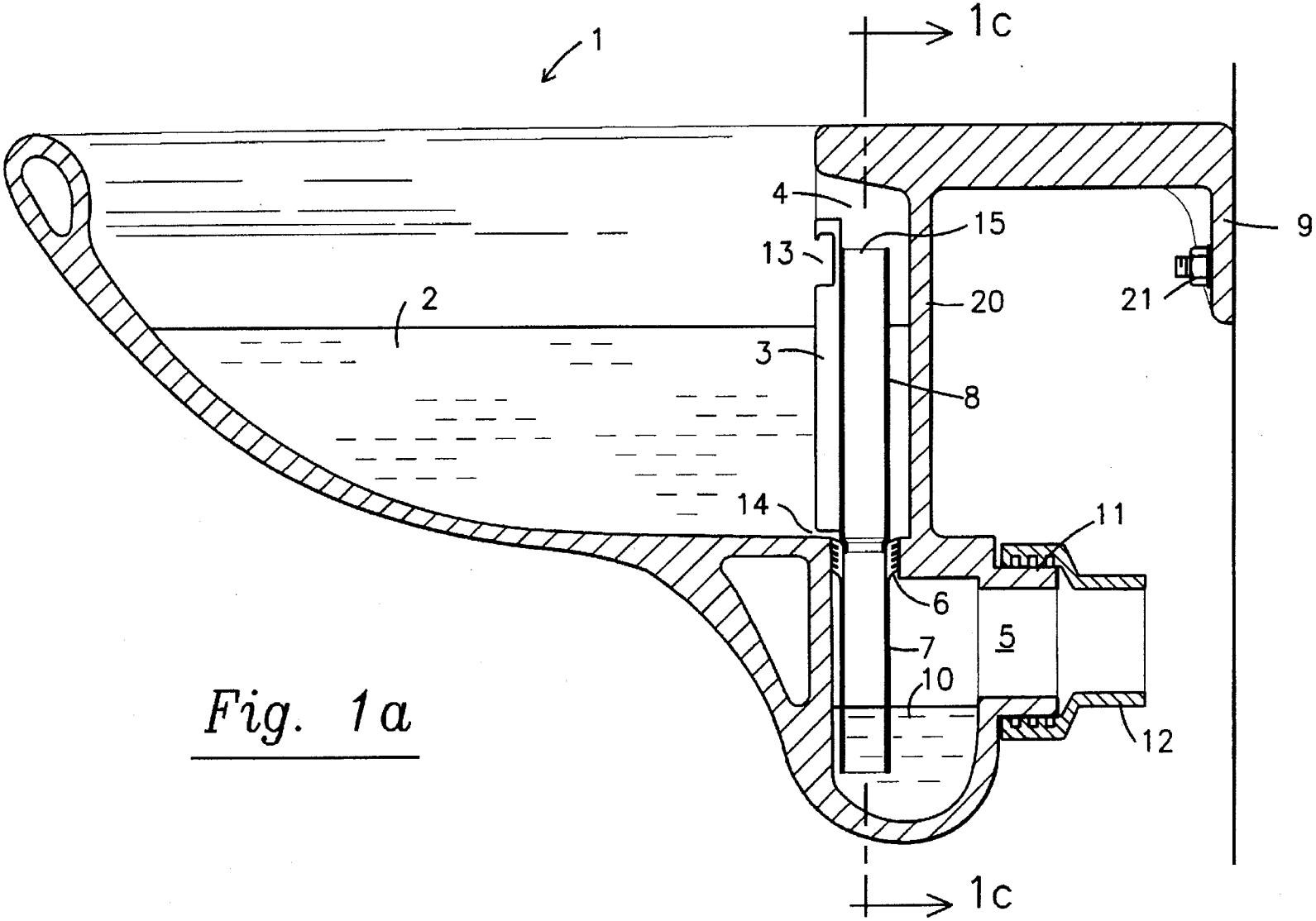
FIG. 1*a* shows a schematic sectional view of a sanitary appliance having a removable wall rigidly attached to the discharge pipe and with a closed outfall according to the invention (section A—A of FIG. 1*c*)

With reference to FIGS. 1, these show a washbasin 1 which comprises a basin 2, separated from a chamber 4 by a wall 3 which is removable. The washbasin further comprises a discharge connection chamber 5 and a rear wall 9 which can be fixed in the wall of a room by means of nuts 21. Situated in the chamber 5 there is an upright discharge pipe 7 which is rigidly attached to said discharge chamber 5. Wall 3 is rigidly attached to an upright discharge pipe 8 which can be placed in the seating 6 formed by the top section of pipe 7 and of chamber 5. Chamber 5, together with the bottommost section of the discharge pipe 7, forms a water seal 10. Via connection 11, the appliance 1 is attached to the water discharge conduit 12 of the room in which the appliance is placed. In order to simplify displacement of wall 3, it is provided with a gripping section 13. In the position depicted in FIG. 1*a*, the outfall is closed, pipe 8 fitting in pipe 7 and the water being unable to drain away.

Figure 1B:
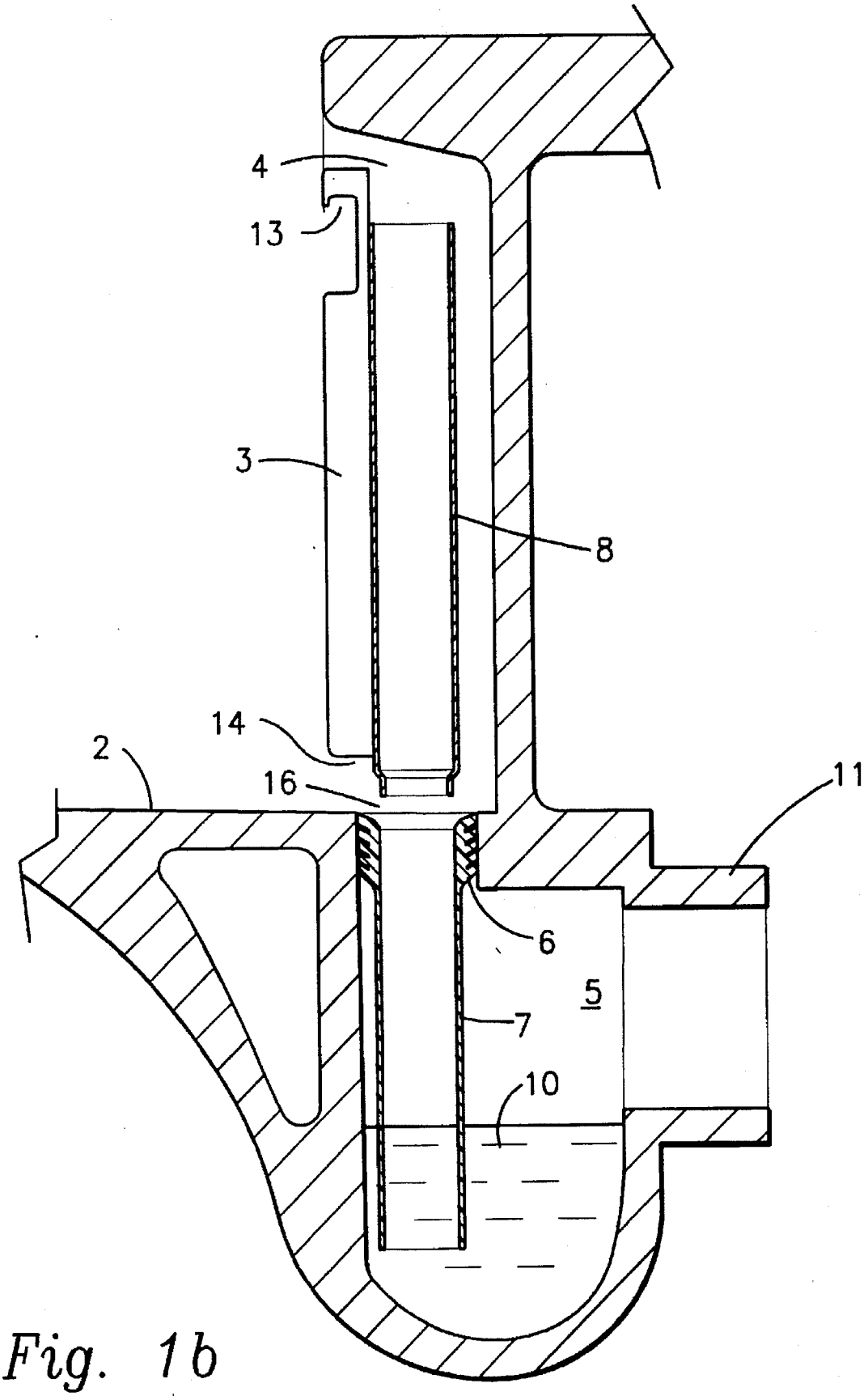
FIG. 1*b* shows a sectional view such as in FIG. 1*a*, but with an open outfall.

When the basin 2 is filled, water is also admitted into chamber 4 via opening 14, the top opening 15 of pipe 8 serving as overflow. If the water is to be allowed to drain away from tide basin 2, gripping section 13 is used to displace the wall 3 upwards, as a result of which the water drains away via opening 16 between pipes 7 and 8. (FIG. 1*b*)

When chamber 4 and/or pipes 7 and 8 are to be cleaned, wall 3 attached to pipe 8 is taken away, and chamber 4 is completely free.

Figure 1C:
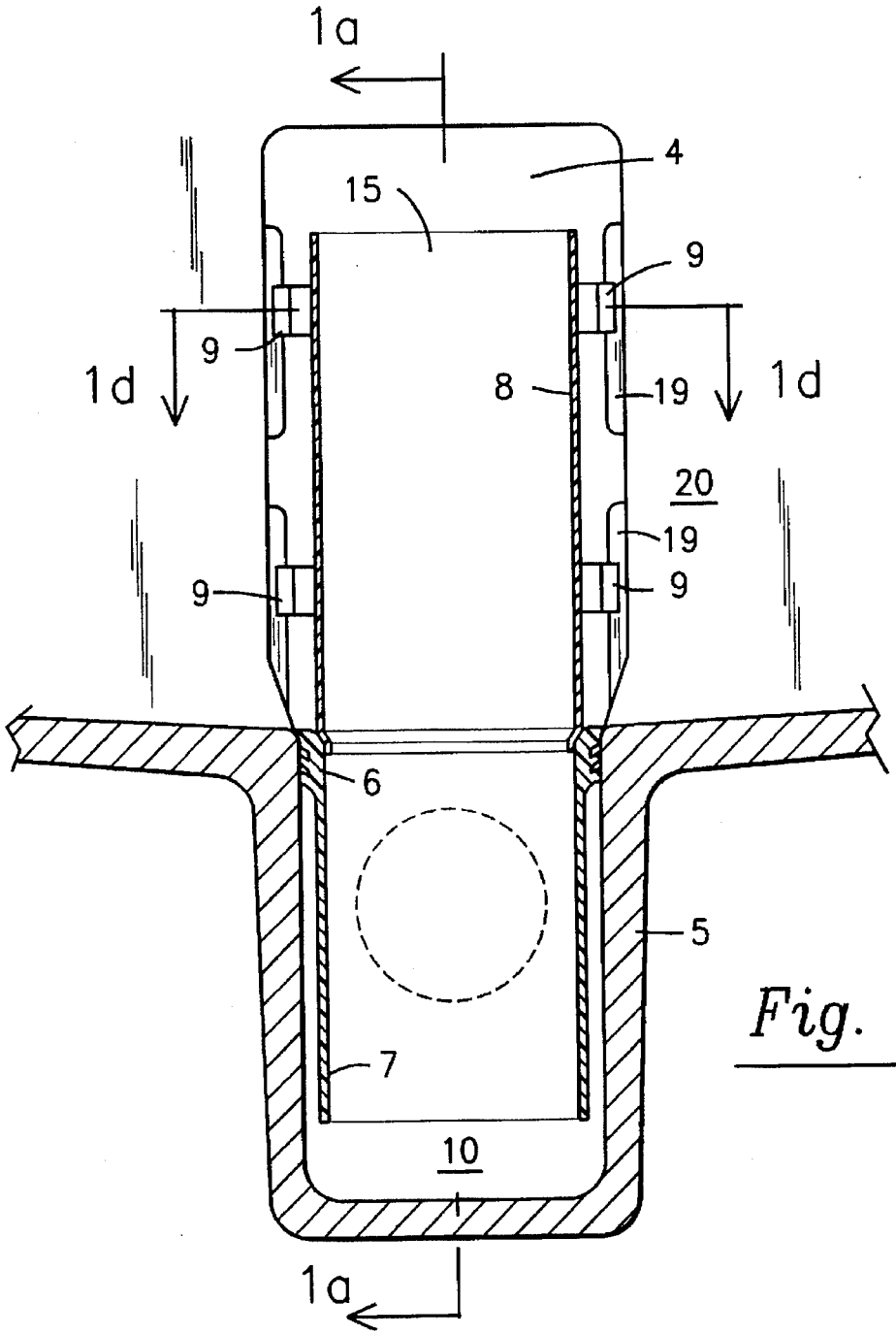
FIG. 1*c* shows the sectional view B—B according to FIG. 1*a;*

FIG. 1*c* shows that pipe 8 comprises guide pieces 9 which can move in guide sections 19 which are attached to wall 20 of chamber 4. The guide pieces 9 slide in sections 19 and, by anyknown means, can be held in two positions, one position where the pipe 8 fits in pipe 7 and the water outfall is closed, and a second position where the water outfall is open.

Figure 1D:
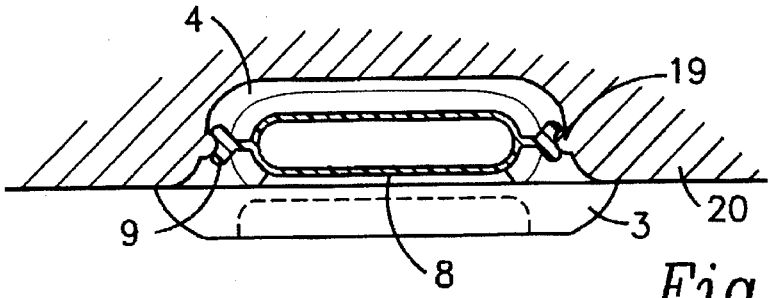
FIG. 1*d* shows the sectional view C—C according to FIG. 1*c;*

FIG. 1*d* shows the sectional view C—C, more in particular the flat shape of pipe 8 and the shape of the guide pieces 9.

Figure 1E:
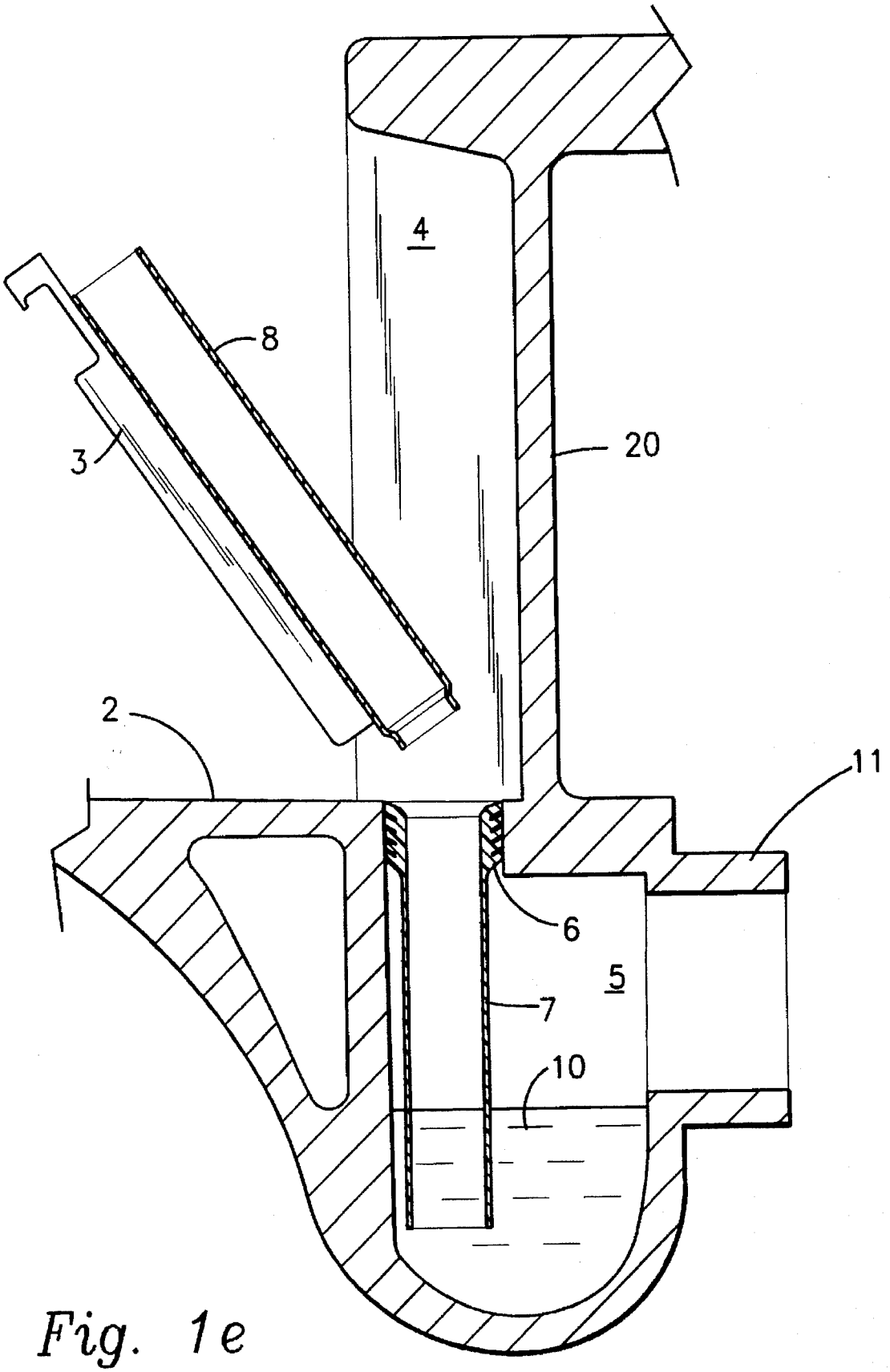
FIG. 1*e* shows the sectional view as in FIG. 1*a*, but with the removable wall removed.

FIG. 1*e* shows the removable wall 3 and the discharge pipe in a position where they have been taken away, so that both chamber 4 and pipe 7 are released.

Figure 2:
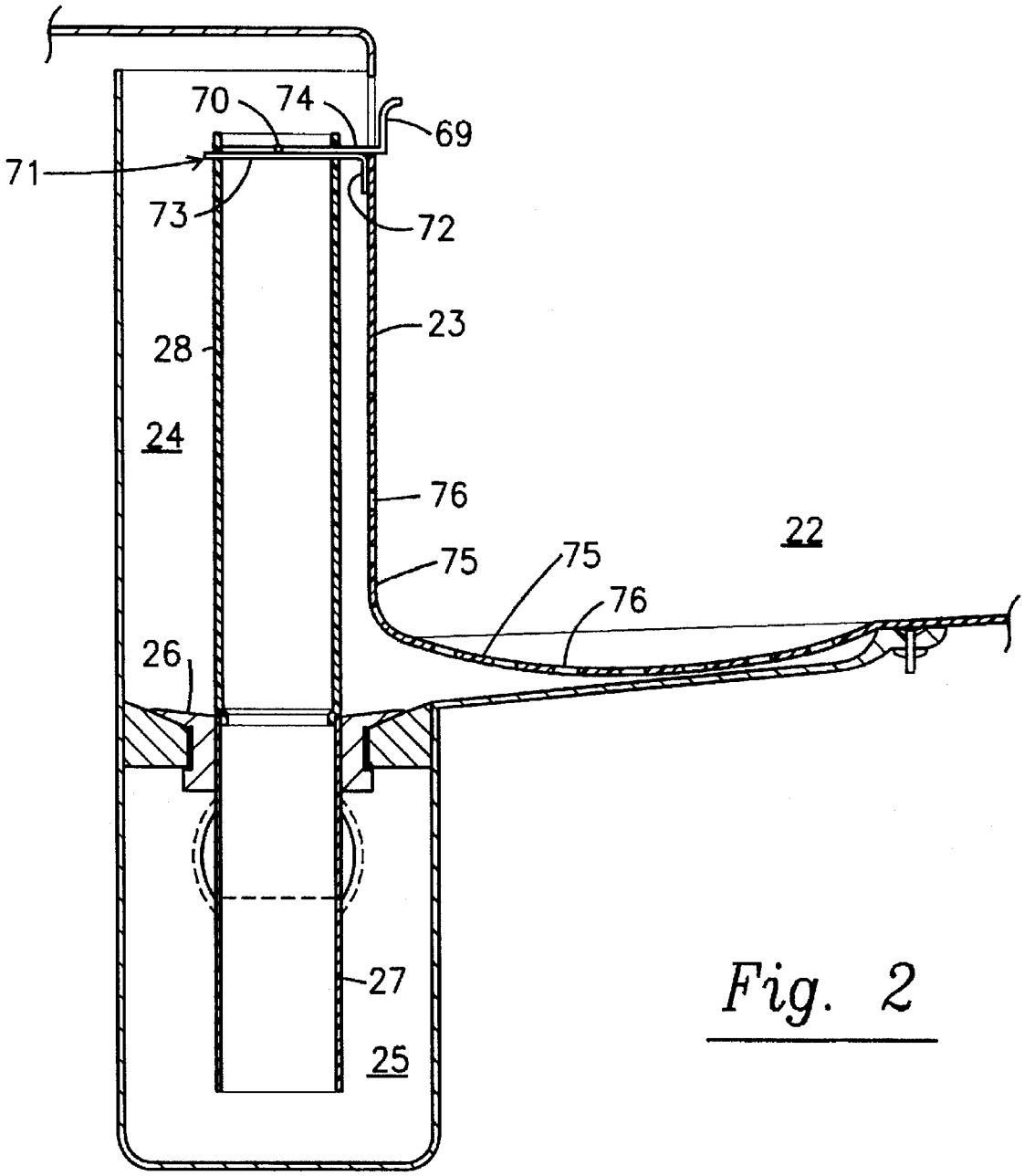
FIG. 2 shows a schematic sectional view of an appliance with a removable wall attached to the discharge pipe, the latter however being capable of being displaced independently.

FIG. 2 shows an example of an application with a removable wall attached to a piece of the discharge pipe, but where the discharge pipe can be displaced independently of the removable wall, for opening or closing the water outfall.

In this figure a sink is depicted schematically, which comprises a basin 22 and a chamber 24, the two separated by a displaceable wall 23. The appliance also comprises a discharge chamber 25 with discharge pipe 27 (the two forming the water seal). Attached to the displaceable wall there is a discharge pipe 28 which fits in a seating 26. To this extent, those parts are comparable with the parts described in FIG. 1. The opening 14 between basin 2 and chamber 4 of FIG. 1 has in this example, shown in FIG. 2, been replaced by a partially rounded portion 75 of wall 23 provided with numerous openings 76. In the case of a sink, this embodiment may prove advantageous.

According to this embodiment, the portion 28 of the upright pipe is therefore attached to the removable wall 23, but said portion 28 can be displaced independently of the wall 23. To this end, the wall 23 is provided with a section 71, formed by a virtually vertical portion 72 rigidly attached to the wall 23, and a horizontal portion 73, the horizontal portion comprising an opening in which the pipe 28 fits. If the pipe has a circular cross-section, the opening will likewise be circular and have a slightly larger diameter than the pipe 28, so that the latter clan move in the opening and can also be separated, via said opening, from the section 71. If the pipe 28 has an oval cross-section, the horizontal portion 73 will likewise have an oval opening. For the sake of simplicity, the opening should match the cross-section of the pipe. Further, on a fixed point 70 of the pipe 28, a guide 74 attached to a handle 69 is fixed, so that the pipe 28 can be displaced between an open and a closed position. According to this embodiment, the removable wall 23 is not displaced for opening and closing the discharge conduit, the position of the handle 69 instead determining the position of pipe 28.

Figure 3B:
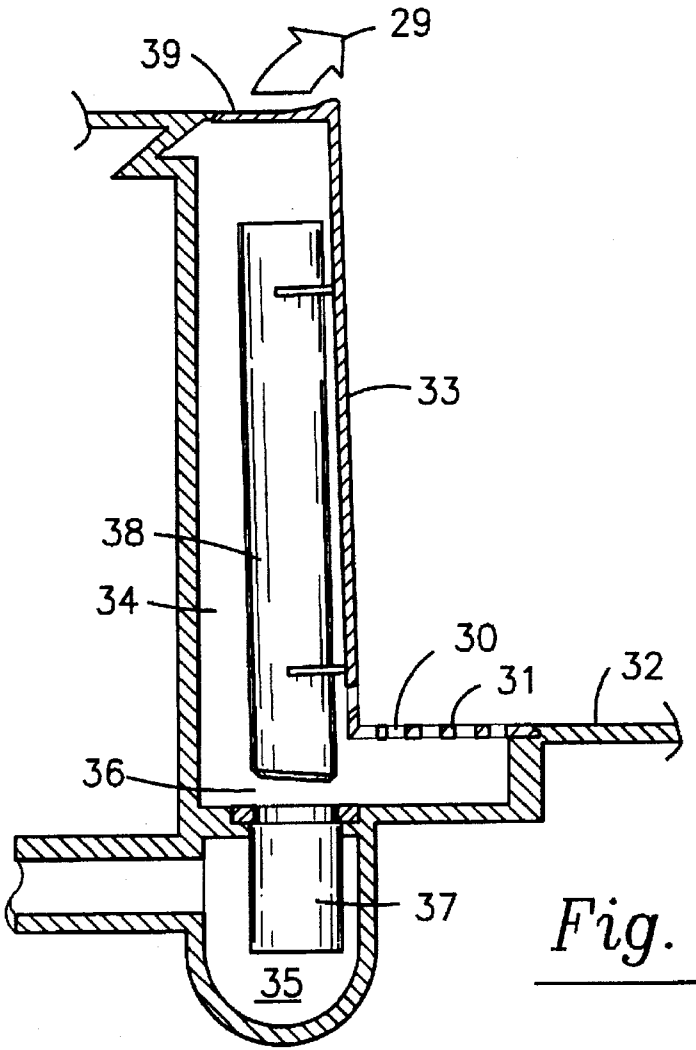
FIGS. 3*a* and 3*b* show a schematic sectional view of a further embodiment, FIG. 3*a* showing the appliance in a position where discharge of water is prevented and FIG. 3*b* in a position where the water can drain away.
Figure 3A:
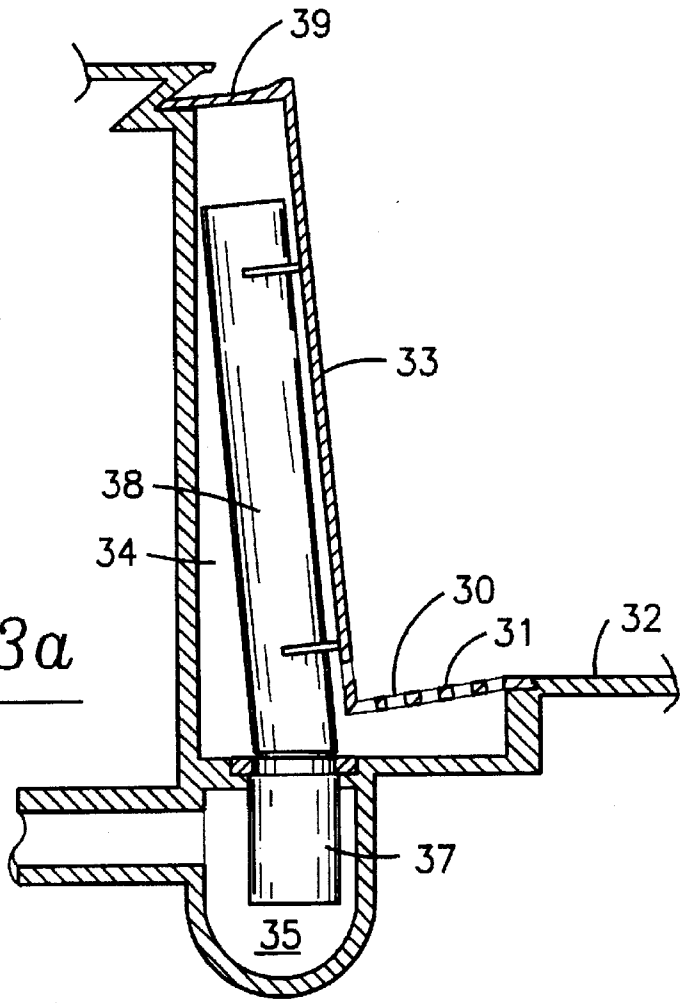

FIGS. 3 show an example in which the displaceable wall 33 comprises a portion of the bottom of the basin 32, and in which the gripping section 39 forms the termination of a portion of the top of the basin 32. The pipe 38, attached to the wall 33, is bevelled underneath and fits in pipe 37 which is permanently seated in chamber 35, these together forming the water seal, as a result of which the water outfall is closed if pipe 38 is placed slantwise on pipe 37 (as shown in FIG. 3*a*) and as a result of which the wall 33 also slopes slightly backwards. In the state shown in FIG. 3*b*, the wall 33 and therefore also the pipe 38 has been put straight, and the outfall is open via opening 36. The underside 31 of the displaceable wall 33 which forms a portion of the bottom of the basin 32, is provided with openings 30 which form the connection between the basin 32 and the cheer 34. If the wall 33 is to be removed, the unit is pulled upwards in the open state (FIG. 3*b*) as indicated by arrow 29.

Figures 4A, 4B, 4C:
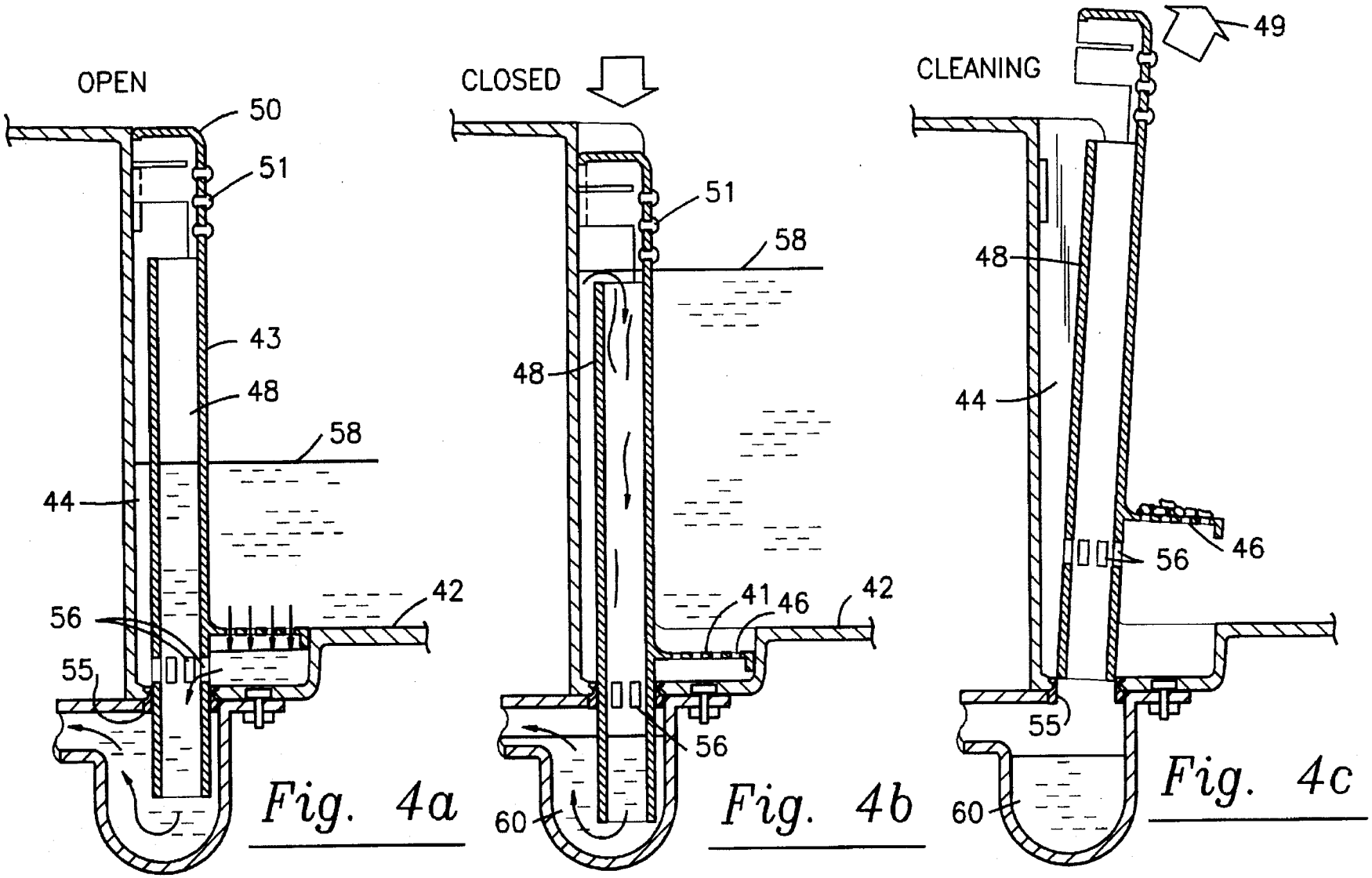
FIGS. 4 show another embodiment, FIG. 4*a* indicating the position where water can drain away, FIG. 4*b* the position where the discharge is prevented, and FIG. 4*c* the position where the wall is taken away.

FIGS. 4 show a further embodiment, in which the displaceable wall is attached to the entire upright pipe. In this embodiment, the shape of the displaceable wall 43 is roughly as in FIGS. 3 with an underside 41 which forms a portion of the basin 42 and which is provided with openings 46, and with a top 50 which forms a portion of the termination of the top edge of the basin 42; in addition, the top comprises rubber strips 51 for convenient displacement of wall 43. Wall 43 forms a unit with discharge pipe 48 which also forms the water seal 60 and which fits in a seating 55 which forms part of chamber 44. At the level of the seating 55, the pipe 48 comprises openings 56 for the water to drain away. In the open state (FIG. 4*a*), the water can drain away via openings 46 and 56, as indicated by the arrows. In the closed state (FIG. 4*b*), pipe 48 fits into seating 55, and seating 55 blocks the openings 56, so that the water cannot flow away, the water level being indicated, by way of example, by the wavy line 58.

For the purpose of cleaning chamber 44, the wall 43 is pulled upwards, as indicated by arrow 49, and the pipe 48 is pulled from the seating 55; chamber 44 then becomes completely accessible. (FIG. 4*c*).

It will be apparent that the invention is not limited to the embodiments which have been described by way of example, but comprises any design in which at least a portion of a wall of a basin is displaceable and removable and is attached to a portion of a discharge pipe of the appliance.

Thus it is possible for the removable wall to be manufactured from a material which is different from that of the basin; for example, the appliance can be made of porcelain and the removable wall of metal which is enameled, as a result of which attachment to the discharge pipe is readily achieved.

As a function of the selected materials it may also be advantageous for the pipe to be rigidly attached to the displaceable wall or for the pipe to be made movable independently of the displaceable wall.

It is also possible for cheer 5, as shown in FIGS. 1, to form part of a standard discharge pipe and for pipe 8 to be placed directly on the standard discharge pipe.

It is further also possible for only a portion of the removable wall to be attached to the discharge pipe, the removable portion consisting of two or more pieces. Alternatively, the removable wall and the pipe can form a single piece.

On the other hand it is likewise possible to combine the invention with a device or valve for letting in air, so that the water seal is protected against being drained accidentally owing to pressure fluctuations in the discharge conduit.

The appliance according to the invention can be any sanitary or similar type of appliance, irrespective of its use which may serve both for personal objectives and for commercial or industrial objectives.

I claim:

1. A sanitary appliance comprising:

a basin for containing a liquid, a first liquid chamber adjoining the basin, a second liquid chamber located below the first liquid chamber and communicating with the first liquid chamber via an opening, the first liquid chamber being separated from the basin by an upright movable wall, the movable wall being attached to an upright liquid discharge pipe, a bottom portion of the upright liquid discharge pipe being seated in the opening to the second liquid chamber, the seated liquid discharge pipe retaining liquid in the basin and the first liquid chamber, the liquid discharge pipe permitting liquid to drain from the basin and the first liquid chamber to the second liquid chamber when the bottom portion of the liquid discharge pipe is removed from the opening to the second liquid chamber by upward movement of the solid upright movable wall, an opening below the removable wall permitting the liquid to flow from the basin to the adjoining liquid chamber to permit liquid level equalization between the basin and the adjoining first liquid chamber.

2. A sanitary appliance according to claim 1 wherein a second liquid discharge pipe, the second upright liquid discharge pipe integrally attached to the second liquid chamber, so that movement of the upright movable wall moves the upright liquid discharge pipe without moving the second liquid discharge pipe.

3. A sanitary appliance according to claim 1 wherein a top opening in the first upright liquid discharge pipe receives overflow liquid from the basin.

4. A sanitary appliance according to claim 1 wherein the upright removable wall has a gripping section at an upper portion to facilitate displacing the upright movable wall upwards.

5. A sanitary appliance according to claim 1 wherein the upright removable wall forms a portion of a top side of the basin.

6. A sanitary appliance according to claim 5 wherein the upright removable wall is enameled metal and the basin is porcelain.

7. A sanitary appliance comprising:

a basin for containing a liquid, a first liquid chamber adjoining the basin, a second liquid chamber located blow the first liquid chamber and communicating with the first liquid chamber via an opening, the first liquid chamber being separated from the basin by an upright movable wall, the movable wall being attached to an upright liquid discharge pipe, a bottom portion of the upright liquid discharge pipe being seated in the opening to the second liquid chamber, the seated liquid discharge pipe retaining liquid in the basin and the first liquid chamber, the liquid discharge pipe permitting liquid to drain from the basin and the first liquid chamber to the second liquid chamber when the bottom portion of the liquid discharge pipe is removed from the opening to the second liquid chamber by upward movement of the solid upright movable wall, an integrally attached second upright liquid discharge pipe in the second liquid chamber aligned with the upright liquid discharge pipe to retain the liquid in the basin, upward movement of the upright removable wall disengaging the upright liquid discharge pipe from alignment with the second upright liquid discharge pipe and thereby discharging liquid from the basin to the second liquid chamber.

8. A sanitary appliance according to claim 7 wherein the upright removable wall and the basin are made from dissimilar materials.

9. A sanitary appliance according to claim 7 wherein the upright removable wall has a handle on a top portion for facilitating upward movement of the solid upright movable wall.

* * * * *